US009033702B2

(12) United States Patent
Min et al.

(10) Patent No.: US 9,033,702 B2
(45) Date of Patent: May 19, 2015

(54) GAS BURNER

(75) Inventors: Moung-Gee Min, Seoul (KR); Jae-Myung Joo, Seoul (KR)

(73) Assignee: Kyungdong Navien Co., Ltd., Pyeongtaek, Gyeonggi-do (KR)

( * ) Notice: Subject to any disclaimer, the term of this patent is extended or adjusted under 35 U.S.C. 154(b) by 788 days.

(21) Appl. No.: 13/386,409

(22) PCT Filed: Jul. 21, 2010

(86) PCT No.: PCT/KR2010/004771
§ 371 (c)(1),
(2), (4) Date: May 8, 2012

(87) PCT Pub. No.: WO2011/010866
PCT Pub. Date: Jan. 27, 2011

(65) Prior Publication Data

US 2012/0225393 A1 Sep. 6, 2012

(30) Foreign Application Priority Data

Jul. 22, 2009 (KR) ..... 10-2009-0066733

(51) Int. Cl.
*F23D 14/04* (2006.01)
*F23D 14/10* (2006.01)

(52) U.S. Cl.
CPC ..... *F23D 14/045* (2013.01); *F23D 14/10* (2013.01)

(58) Field of Classification Search
CPC ..... F23D 14/04; F23D 14/58; F23D 14/10; F23D 14/26
USPC ..... 431/355, 278, 285, 328, 354; 126/92 AC
See application file for complete search history.

(56) References Cited

U.S. PATENT DOCUMENTS 5,318,438 A * 6/1994 Sugahara et al. ..... 431/285
5,525,054 A * 6/1996 Nakaura et al. ..... 431/285
6,786,717 B2 * 9/2004 Shimazu et al. ..... 431/354

FOREIGN PATENT DOCUMENTS

JP 07-310905 A 11/1995
JP 09159115 A * 6/1997 ..... F23D 14/02
JP 2001-182909 A 7/2001
JP 2001-182911 A 7/2001
KR 20-1992-0001735 Y1 3/1992

* cited by examiner

*Primary Examiner* — Steven B McAllister
*Assistant Examiner* — Nikhil Mashruwala
(74) *Attorney, Agent, or Firm* — Mintz Levin Cohn Ferris Glovsky and Popeo, P.C.; Kongsik Kim

(57) ABSTRACT

The present invention relates to a gas burner in which a burner body and a side plate are assembled together without a welding process, to thereby simplify manufacturing procedures and reduce manufacturing costs. To accomplish this, the gas burner of the present invention includes a plurality of burner units (110), each of which has a burner body (111) with a main flame being formed at the top thereof, a side plate (112) which forms auxiliary flame holes (116) in the spaces between both side surfaces of the burner body (111) and the side plate (112), and a plurality of supports (113, 114) protruding from the side plate (112). Both ends of each of the burner units (110) are supported by first and second brackets (200*a*, 200*b*), respectively. The supports (113, 114) formed at the side plate (112) of the burner unit are brought into contact with and are supported by supports (123, 124) formed at a side plate (122) of an adjacent burner unit (120).

2 Claims, 6 Drawing Sheets

GAS BURNER

CROSS-REFERENCES TO RELATED APPLICATIONS

This application is a U.S. national phase application, pursuant to 35 U.S.C. §371, of PCT/KR2010/004771, filed Jul. 21, 2010, designating the United States, which claims priority to Korean Application No. 10-2009-0066733, filed Jul. 22, 2009. The entire contents of the aforementioned patent applications are incorporated herein by this reference.

TECHNICAL FIELD

The present invention relates to a gas burner, and more particularly, to a gas burner in which a plurality of burner units for forming a flame are mutually supported, thereby making it possible to simplify manufacturing processes.

BACKGROUND ART

Most household gas boilers employ a semi Bunsen burner due to stable inflammability. This semi Bunsen burner mixes some air (primary air) supplied from a blower with gas fuel in advance and supplies the mixture to a combustion unit to form a flame. The semi Bunsen burner supplies the rest of the air (secondary air) supplied from the blower to a flame forming part, thereby inducing complete combustion.

To prevent harmful emissions (e.g. CO) from being excessively discharged from such a burner, the output of the burner is generally required to be less than 2,000 kcal/h. In this case, when the output per burner unit is designed to be low, many burner units should be installed to meet the maximum output required from the boiler. As such, the overall volume of the boiler is increased.

To overcome this problem, a premix burner characterized by a small volume, high load, and low NOx has been used. However, the premix burner has difficulty in control because the range of an air ratio for stable combustion is narrow.

A high-load burner based on a concept of a lean-rich burner adopting advantages of the aforementioned burners has been developed and used. The lean-rich burner is designed so that flame units in which excessive air is burned on one side and flame units in which excessive gas is burned on the other side are alternately provided. In the burner having this structure, a mixed gas ejected from the two types of flame units participates in mutual combustion, so that stable high-load combustion and low NOx combustion can be carried out by the burner having a small volume.

Most lean-rich burners are designed in the form of a dual gas pipe (in which one gas pipe is used for an air-rich mixture and the other gas pipe is used for a gas-rich mixture), and thus have a complicated structure and a large number of parts, which leads to an increase in manufacturing cost.

These lean-rich burners have the same basic structure as a burner shown in FIGS. 1 and 2.

FIG. 1 is a plan view showing a burner unit for a conventional gas burner, and FIG. 2 is a front view showing the burner unit of FIG. 1.

The burner unit is constructed so that a burner body 10 having main flame holes 11 formed in a top face thereof is coupled with side plates 20 having auxiliary flame holes 21 that are formed between the burner body 10 and the side plates 20. The side plates 20 are coupled to the burner body 10 by welding. Each side plate has a plurality of weld spots 30 at regular intervals in a lengthwise direction thereof.

In this manner, when the burner body 10 and the side plates 20 are coupled by welding, the number of manufacturing processes is increased, and thus the cost of production is increased.

SUMMARY OF THE DISCLOSURE

Technical Problem

Accordingly, the present invention has been made keeping in mind the above problems occurring in the related art, and an objective of the present invention is to provide a gas burner capable of eliminating a welding process when a burner body and a side plate are assembled, providing a simplified manufacturing process and an inexpensive manufacturing cost.

Technical Solution

To accomplish the objective, the present invention provides a gas burner in which: a plurality of burner units (100) are provided, each of which has a burner body (110) forming a main flame at an upper end thereof, a side plate (120) which forms an auxiliary flame in spaces between opposite sides of the burner body (110) and the side plate (112), and a plurality of protruding supports (121, 122); opposite ends of each of the burner units (100) are supported by first and second brackets (200*a*, 200*b*), respectively; and the supports (121*a*, 122*a*) formed on the side plate (120*a*) are contacted with and supported by supports (121*b*, 122*b*) formed on a side plate (120*b*) of an adjacent burner unit.

Advantageous Effects

According to the present invention, since it is unnecessary to weld the burner body and the side plate, the number of manufacturing processes is reduced, and thus the manufacturing cost is reduced. Further, since the welding is not required, it is possible to assemble the gas burner again when the gas burner is incorrectly assembled.

DESCRIPTION OF MAJOR SYMBOL IN THE ABOVE FIGURES

100, 110, 120: burner unit
111. 121: burner body
112, 122: side plate
113, 123: knob
114, 124: bent part

DETAILED DESCRIPTION OF EMBODIMENTS

Hereinafter, the construction and operation of exemplary embodiments of the present invention will be described in detail with reference to the accompanying drawings.

Figure 1:
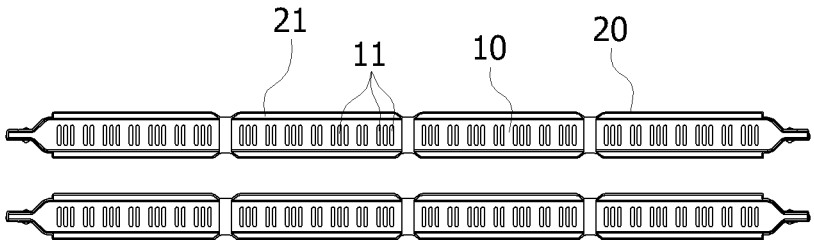
FIG. 1 is a plan view showing a burner unit for a conventional gas burner.
Figure 2:
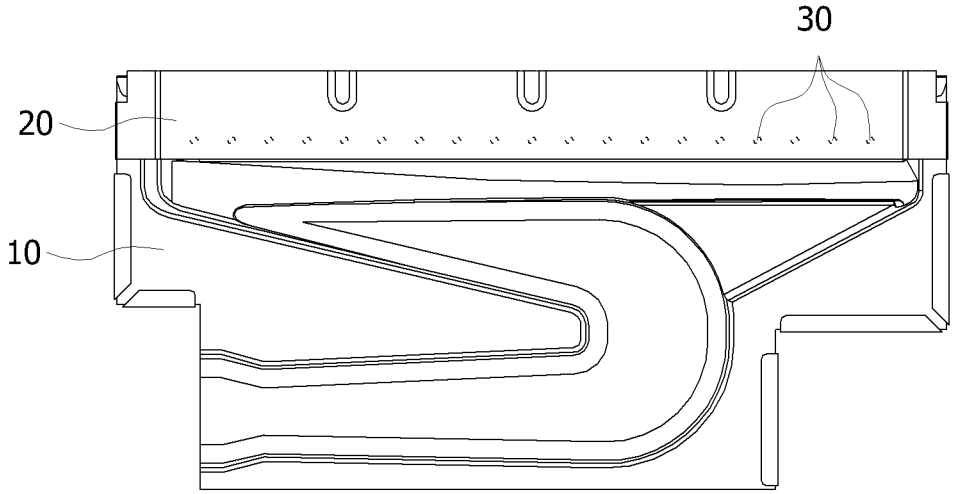
FIG. 2 is a front view showing the burner unit of FIG. 1.
Figure 3:
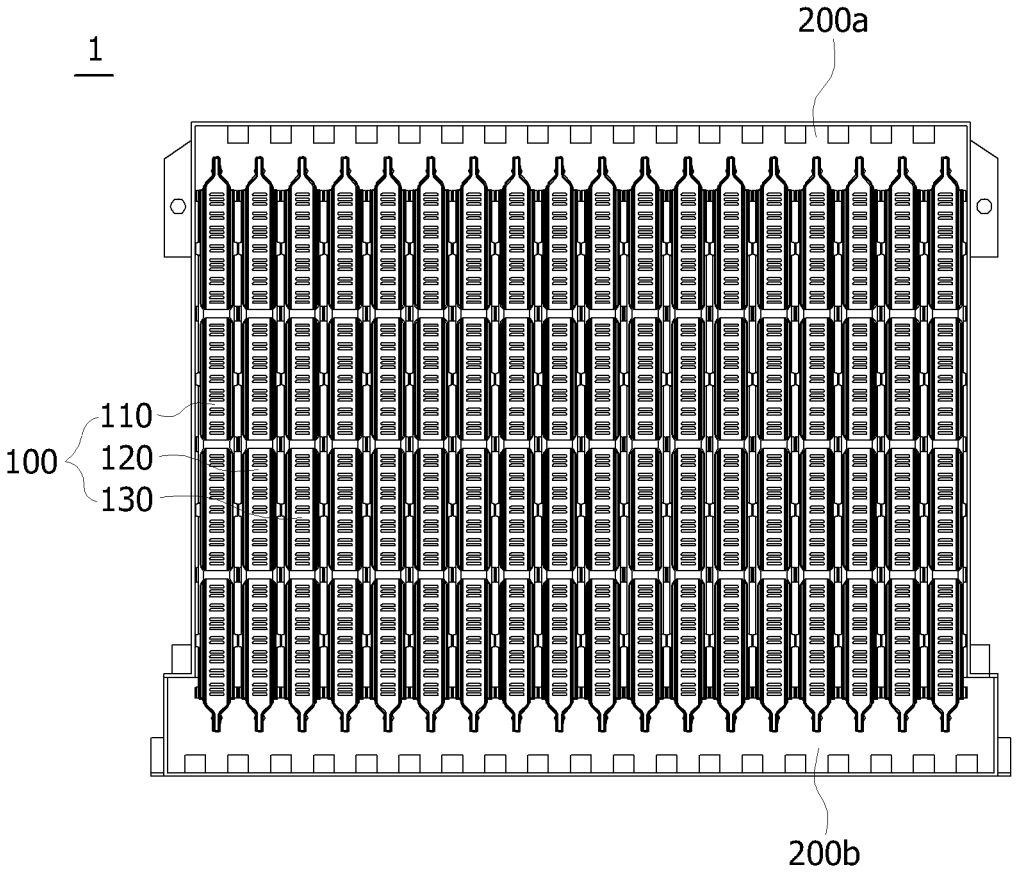
FIG. 3 is a plan view showing a gas burner according to an embodiment of the present invention.

FIG. 3 is a plan view showing a gas burner according to an embodiment of the present invention.

The gas burner 1 includes burner units 100 forming a flame, and first and second brackets 200*a* and 200*b* supporting opposite ends of the burner units 100.

Each burner unit 100 has a structure in which a plurality of burner units 110, 120 and 130 are disposed in a row at regular intervals.

Opposite ends of each of the burner units 110, 120 and 130 have a shape in which a plurality of plates are bent so as to have a narrower width than a burner body, and are inserted into and fixed in grooves formed in the first and second brackets 200*a* and 200*b*.

Figure 4:
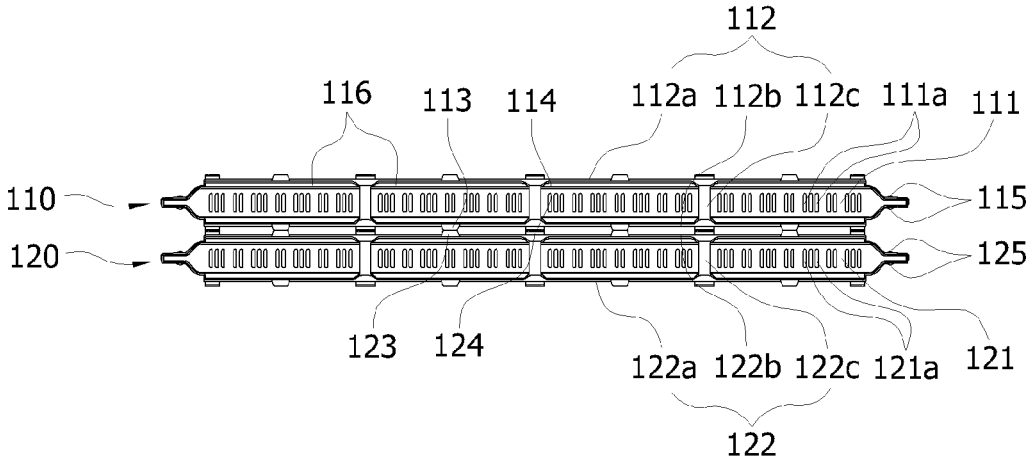
FIG. 4 is a plan view showing a structure in which burner units of the present invention are mutually supported.

FIG. 4 is a plan view showing a structure in which the burner units are of the present invention mutually supported.

Two of the burner units 110 and 120 are mutually supported.

The first burner unit 110 is made up of a burner body 111 and side plates 112*a* and 112*b* that are installed apart from opposite upper sides of the burner body 111 by a predetermined interval.

The two side plates 112*a* and 112*b* are coupled to each other by bridges 112*c*.

The burner body 111 is provided with a plurality of main flame holes 111*a* in the top surface thereof at regular intervals, and domed knobs 115 on opposite sides of each end thereof.

Spaces between the side plates 112*a* and 112*b* and the outer sides of the burner body 111 are formed as auxiliary flame holes 116.

Supports 113 and 114 protrude from each of the side plates 112*a* and 112*b*.

The supports 113 and 114 may include a plurality of protrusion parts 113 formed by embossing portions of the side plate 112, and a plurality of bent parts 114 formed by bending portions of a lower end of the side plate 112. In this embodiment, both the protrusion parts 113 and the bent parts 114 are provided. However, only the protrusion parts 113 may be provided.

The second burner unit 120 has the same shape and structure as the first burner unit 110. That is, the second burner unit 120 includes a burner body 121, side plates 122*a* and 122*b*, bridges 122*c*, supports 123 and 124, and knobs 125.

The protrusion parts 113 of the first burner unit 110 are adapted to come into contact with the protrusion parts 123 of the second burner unit 120. Thus, the two burner units 110 and 120 are adapted to be mutually supported.

Further, the bent parts 114 of the first burner unit 110 are adapted to come into contact with the bent parts 124 of the second burner unit 120. Thus, the two burner units 110 and 120 are adapted to be mutually supported.

Accordingly, unlike the related art, it is unnecessary to weld the burner body 111 and the side plate 112 to each other, and the two burner units 110 and 120 are installed to be mutually supported by the supports 113, 114, 123 and 124. Thereby, the assembly is completed, and thus a manufacturing process is simplified.

Figure 5:
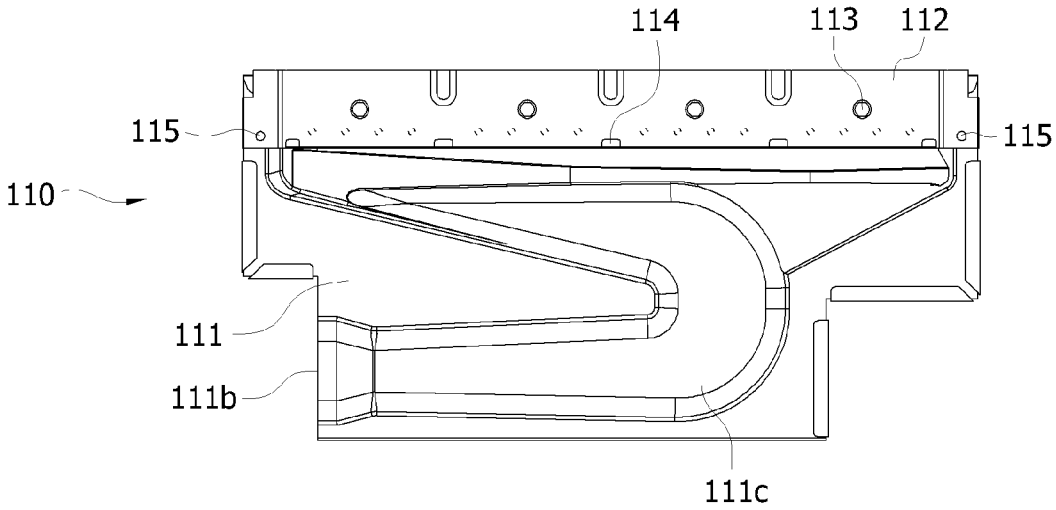
FIG. 5 is a front view showing the burner unit of the present invention.

FIG. 5 is a front view showing the burner unit of the present invention.

The burner unit 110 includes a mixture inlet 111*b* into which air and fuel gas flow, and a main mixing pipe 111*c* that forms a channel in which the air and the fuel gas flowing through the mixture inlet 111*b* are mixed and flow.

The plurality of protrusion parts 113 are formed on the side plate 112 at predetermined intervals in a lengthwise direction. The plurality of bent parts 114 are formed at the lower end of the side plate 112, which is located below the protrusion parts 113, at predetermined intervals in a lengthwise direction.

The knobs 115 are formed at opposite upper ends of the burner body 111. The knobs 115 are inserted into the holes formed in the side plate 112. Due to these knobs 115, the side plate 112 is prevented from being separated from the burner body 111 in a vertical direction.

Figure 6:
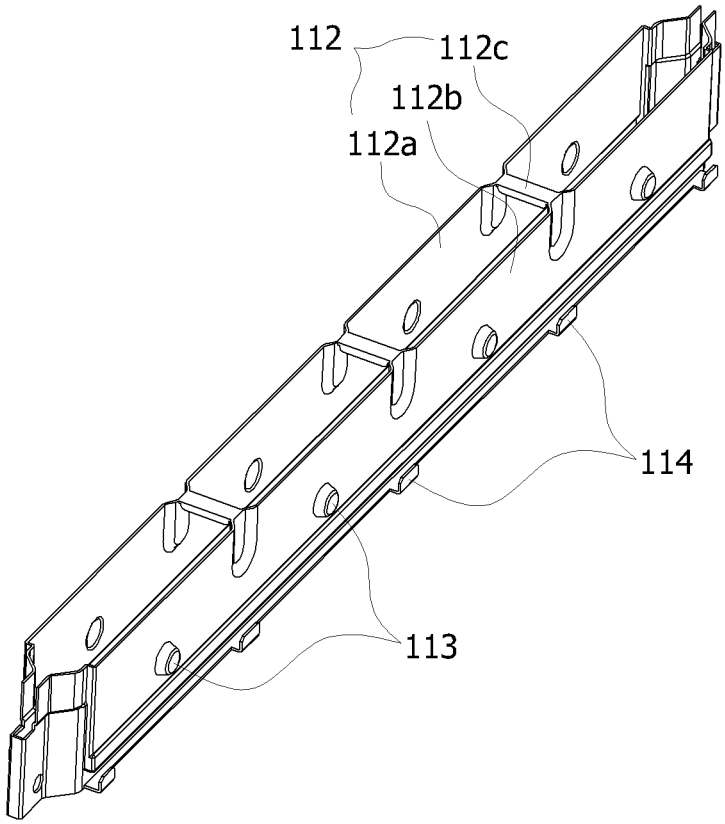
FIG. 6 is a perspective view showing a side plate of the present invention.

FIG. 6 is a perspective view showing a side plate of the present invention.

The side plate 112 includes two side plate bodies 112*a* and 112*b* having the auxiliary flame holes 116 formed between the side plate bodies 112*a* and 112*b* and upper outer sides of the burner body 111, and bridges 112*c* connecting the side plate bodies 112*a* and 112*b* to each other. The protrusion parts 113 and the bent parts 114 protrude from the side plate bodies 112*a* and 112*b*.

Figure 7:
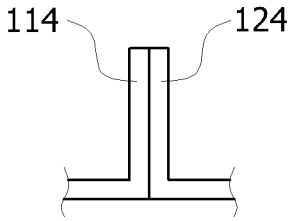
FIG. 7 is a partial cross-sectional view showing the state in which bent parts are mutually supported in the side plate of the present invention.

FIG. 7 is a partial cross-sectional view showing the state in which bent parts are mutually supported in the side plate of the present invention.

The bent part 114 of the first burner unit 110 is bent in an L shape, and the bent part 124 of the second burner unit 110 is bent in a symmetrical shape with respect to the bent part 114.

The two bent parts 114 and 124 are mutually supported, so that the burner unit can be simply installed without welding the side plate 112 to the burner body 111.

The gas burner having the aforementioned structure can realize a structure of the Bunsen burner in which the same concentration of mixture is burned from the main flame holes and the auxiliary flame holes, and a structure of the lean-rich burner in which the concentrations of the mixtures burned from the main flame holes and the auxiliary flame holes are different from each other.

In the case of realizing the Bunsen burner structure, some of the mixture flowing in the main mixing pipe 111*c* is supplied to the main flame holes 111*a* and the rest is supplied to the auxiliary flame holes 116.

Meanwhile, in the case of realizing the lean-rich burner structure, some of the mixture flowing in the main mixing pipe 111*c* is supplied to the main flame holes 111*a* and the rest is supplied to the auxiliary flame holes 116. Here, when air inflow holes are formed so that air outside the burner unit 110 flows into the mixture flowing to the auxiliary flame holes 116, an air-rich mixture is supplied to the auxiliary flame holes 116. Preferably, the air inflow holes are formed in a venturi shape so that the air outside the burner unit 110 flows in smoothly.

The invention claimed is:

1. A gas burner in which:

a plurality of burner units (110) are provided, each of which has a burner body (111) forming a main flame at an upper end thereof, a side plate (112) which forms auxiliary flame holes (116) in spaces between opposite sides of the burner body (111) and the side plate (112), and a plurality of supports (113, 114) protruding from the side plate (112);

opposite ends of each of the burner units (110) are supported by first and second brackets (200*a*, 200*b*), respectively;

the supports (113, 114) formed on the side plate (112) of the burner unit (110) are contacted with and supported by supports (123, 124) formed on a side plate (122) of an adjacent burner unit (120); and the supports (113,114) include a plurality of protrusion parts (113) formed by embossing portions of the side plate (112), and a plurality of bent parts (114) formed by bending portions of a lower end of the side plate (112).

2. The gas burner according to claim 1, wherein the burner body (111) includes knobs (115) formed at opposite upper ends thereof, and the knobs (115) are inserted into holes formed in the side plate (112).

* * * * *